US009090365B2

(12) United States Patent
Yu Chen

(10) Patent No.: US 9,090,365 B2
(45) Date of Patent: Jul. 28, 2015

(54) STEEL STRAPPING TOOL WITH A PRESSING STRAP STRUCTURE

(76) Inventor: Hsiu-Man Yu Chen, Taichung (TW)

( * ) Notice: Subject to any disclaimer, the term of this patent is extended or adjusted under 35 U.S.C. 154(b) by 501 days.

(21) Appl. No.: 13/546,928

(22) Filed: Jul. 11, 2012

(65) Prior Publication Data

US 2012/0272836 A1 Nov. 1, 2012

Related U.S. Application Data

(63) Continuation-in-part of application No. 12/619,975, filed on Nov. 17, 2009, now abandoned.

(51) Int. Cl.

| | |
|---|---|
| ***B25B 13/30*** | (2006.01) |
| ***B25B 13/02*** | (2006.01) |
| ***B65B 13/02*** | (2006.01) |
| ***B65B 13/30*** | (2006.01) |

(52) U.S. Cl.

CPC ..... *B65B 13/025* (2013.01); *B65B 13/305* (2013.01)

(58) Field of Classification Search

CPC ..... B65B 13/22; B65B 13/025; B65B 13/305
USPC ..... 140/93.2, 93.4, 150–154; 59/582, 592; 100/29, 32, 33 R
See application file for complete search history.

(56) References Cited

U.S. PATENT DOCUMENTS

| | | | | |
|---|---|---|---|---|
| 3,241,579 A * | 3/1966 | Partridge | ..... | 140/93.2 |
| 6,729,357 B2 * | 5/2004 | Marsche | ..... | 140/93.2 |

FOREIGN PATENT DOCUMENTS

| | | |
|---|---|---|
| TW | 537285 | 6/2003 |

* cited by examiner

*Primary Examiner* — Debra Sullivan
(74) *Attorney, Agent, or Firm* — Ming Chow; Sinorica, LLC

(57) ABSTRACT

A steel strapping tool with a pressing strap structure is provided. The steel strapping tool includes a base and a compressed block at one side of the base. The base has a pivot block extending from a front side thereof. A cutting unit is disposed on the base. The cutting unit includes a fixing seat which has an accommodating trough therein, a top engaging rod unit disposed in the accommodating trough, a cutting assembly having one end coupled to the top engaging rod unit and received in the accommodating trough. The base has a through hole which is transversely disposed beside the compressed block. The cutting unit includes a hook member located beside the cutting assembly. The hook member extends underneath the compressing blocks and is accommodated in the through hole of the base.

4 Claims, 10 Drawing Sheets

STEEL STRAPPING TOOL WITH A PRESSING STRAP STRUCTURE

The current application is a continuation-in-part of, and claims a priority to the U.S. Ser. No. 12/619,975 filed on Nov. 17, 2009 now abandoned.

BACKGROUND OF THE INVENTION

1. Field of the Invention

The present invention relates to a steel strapping tool with a pressing strap structure.

2. Description of the Prior Art

Referring to FIG. 1, a conventional steel strapping tool as disclosed in Taiwan patent publication No. 537285 comprises a base 1 having a compressed block, a fixing seat 2, a cutting unit 3 having a compressing block, a top engaging rod unit 4, a release rod unit 5, and a pull rod unit 6. The fixing seat 2 is disposed on the base 1. The cutting unit 3 is disposed in the fixing seat 2. A cutter 7 is provided behind one side of the cutting unit 3. The cutting unit 3 is connected with the top engaging rod unit 4 and driven by the top engaging rod unit 4. The fixing seat 2 is pivotally connected with the release rod unit 5 for pressing a steel strap. One side of the release rod unit 5 is pivotally connected with the pull rod unit 6. By pulling the top engaging rod unit 4 to drive the cutting unit 3, a steel strap disposed between the cutting unit 3 and the base 1 is pressed and secured to be an integral one by the compressing block of the cutting unit 3 and the compressed block of the base 1. After that, the cutter 7 is used to cut the surplus steel strap to complete the packing procedure of the object. The bottom of the cutting unit 3 and the base 1 are parallel.

The conventional steel strapping tool uses the cutting unit 3 to press the steel strap for the steel strap to be bucked. However, the bottom of the cutting unit 3 and the base 1 are parallel, which is laborious to use the steel strapping tool.

After the packing procedure, the steel strap is secured to be one-piece by press of the compressing block of the cutting unit 3 and the compressed block of the base 1. The upper and lower sides have a shape corresponding to the compressing block and the compressed block, so the steel strap is stuck on the compressed block of the base 1. The user has to separate the steel strap from the compressed block of the base 1. However, it is difficult to separate the steel strap and the base 1 after the packing procedure, and the packing and fastening effect of the steel strap will be influenced. For example, the user holds the steel strapping tool and applies a force to separate the steel strap from the compressed block of the base 1. It is very inconvenient to separate the steel strap for next packing procedure.

Accordingly, the inventor of the present invention has devoted himself based on his many years of practical experiences to solve this problem how to separate the steel strap from the compressed block of the base.

SUMMARY OF THE INVENTION

A steel strapping tool with a pressing strap structure is provided. The steel strapping tool includes a base, a compressed block at one side of the base. The base has a pivot block extending from a front side thereof. A cutting unit is disposed on top of the base. The cutting unit includes a fixing seat which has an accommodating trough therein, a top engaging rod unit disposed in the accommodating trough, a cutting assembly having one end coupled to the top engaging rod unit and received in the accommodating trough. The base has a through hole which is transversely disposed beside the compressed block. The cutting assembly includes a cutting body and a connecting member which extends frontward from one side of the cutting body and passes through the fixing seat. The connecting member is pivotally connected with the pivot block of the base. Between the cutting body and the base defines an included angle. The cutting unit comprises a hook member located beside the cutting assembly. The hook member includes a link hole, a stop pin and a hook block disposed under the link hole. The link hole is adapted for insertion of one end of the stop pin. The other end of the stop pin is inserted in the cutting assembly to link the hook member and the cutting assembly. The hook block extends underneath the compressing blocks and is accommodated in the through hole of the base.

Thereby, the front end of the cutting body holds against a steel strap which is inserted in the steel strapping tool, and then the cutting body is to press the steel strap entirely so as to achieve a firm pressing effect. After the tool strapping tool fastens and cuts the steel strap, the hook block of the cutting body moves upward to assist in hooking the steel strap out, preventing the steel strap from getting stuck on the compressed block to enhance the steel strapping tool.

DETAILED DESCRIPTION OF THE PREFERRED EMBODIMENTS

Figure 1:
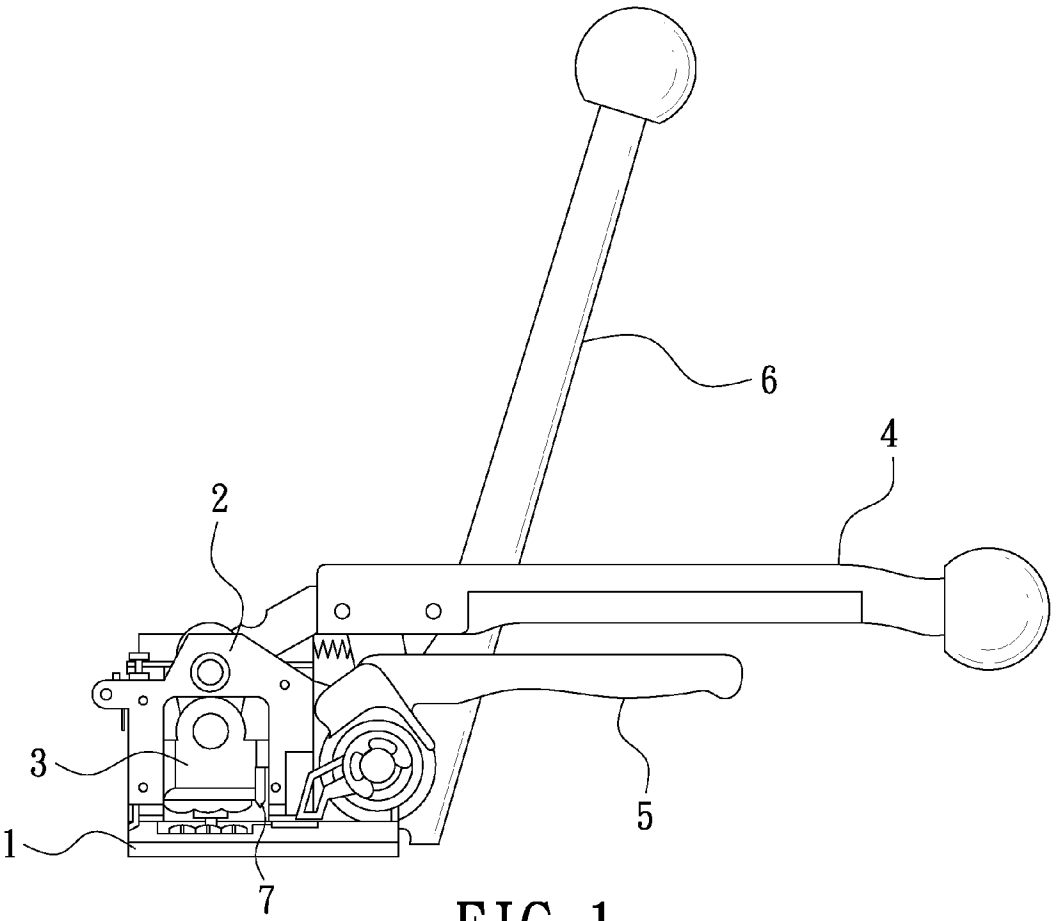
FIG. 1 PRIOR ART
FIG. 1 is a side view of a conventional steel strapping tool.
Figure 2:
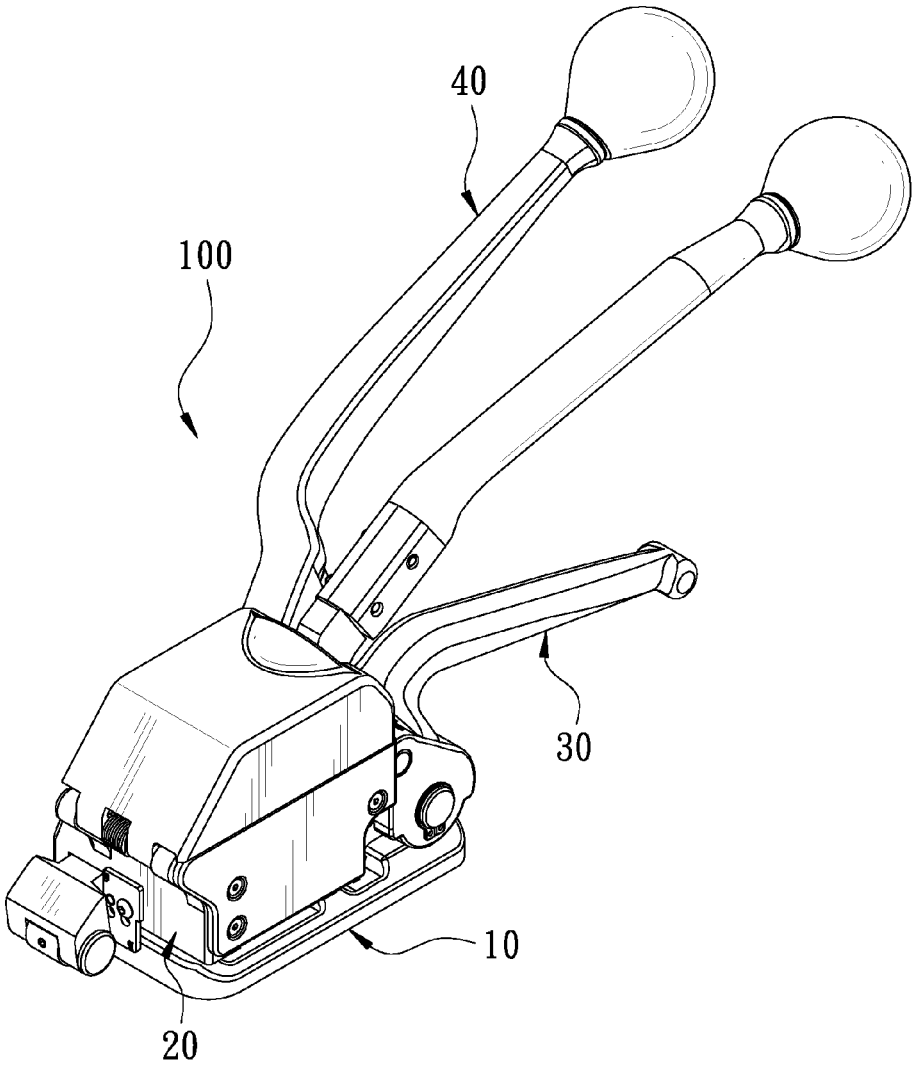
FIG. 2 is a perspective view of the present invention.
Figure 3:
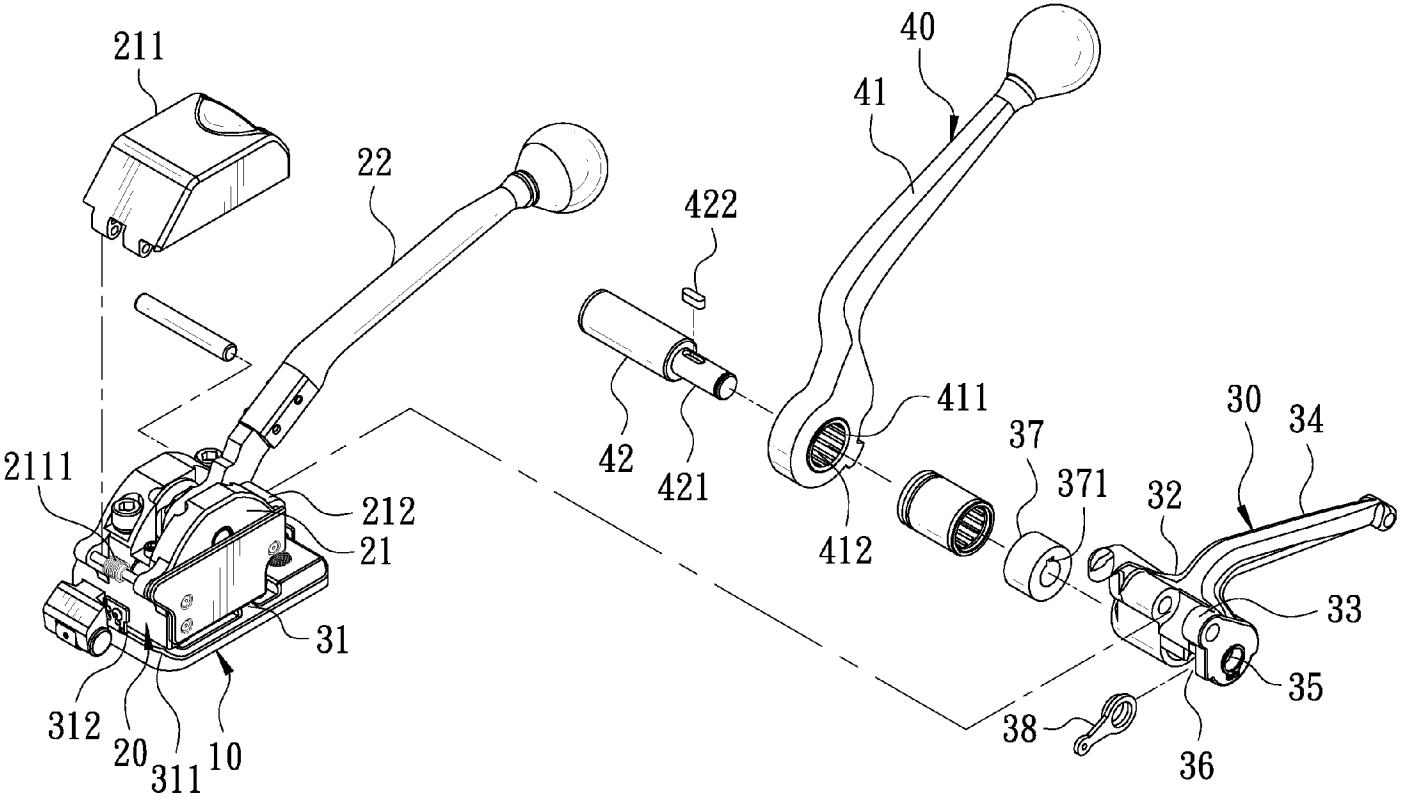
FIG. 3 is a partially exploded view of the present invention.
Figure 4:
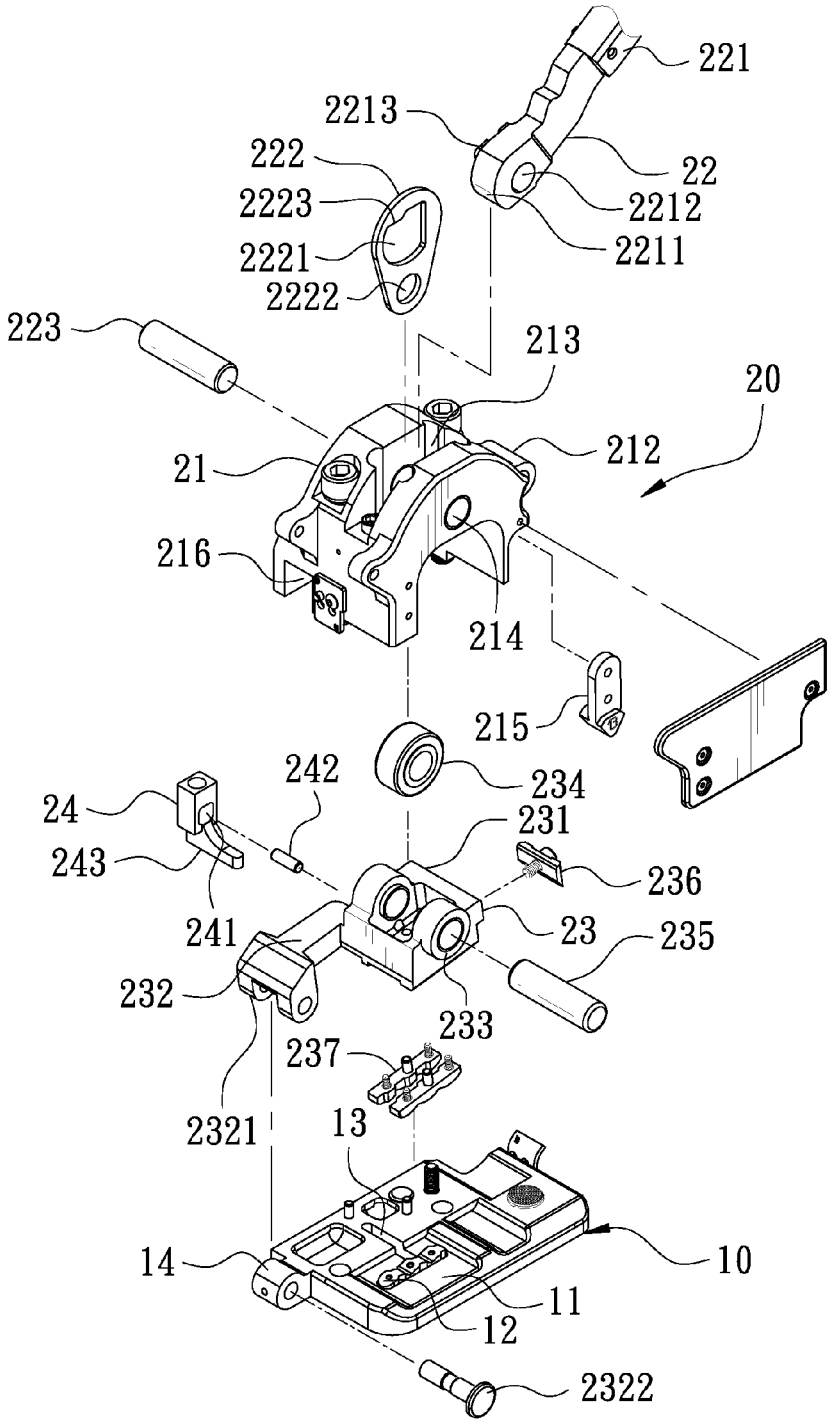
FIG. 4 is an exploded view showing a base and a cutting unit of the present invention.
Figure 5:
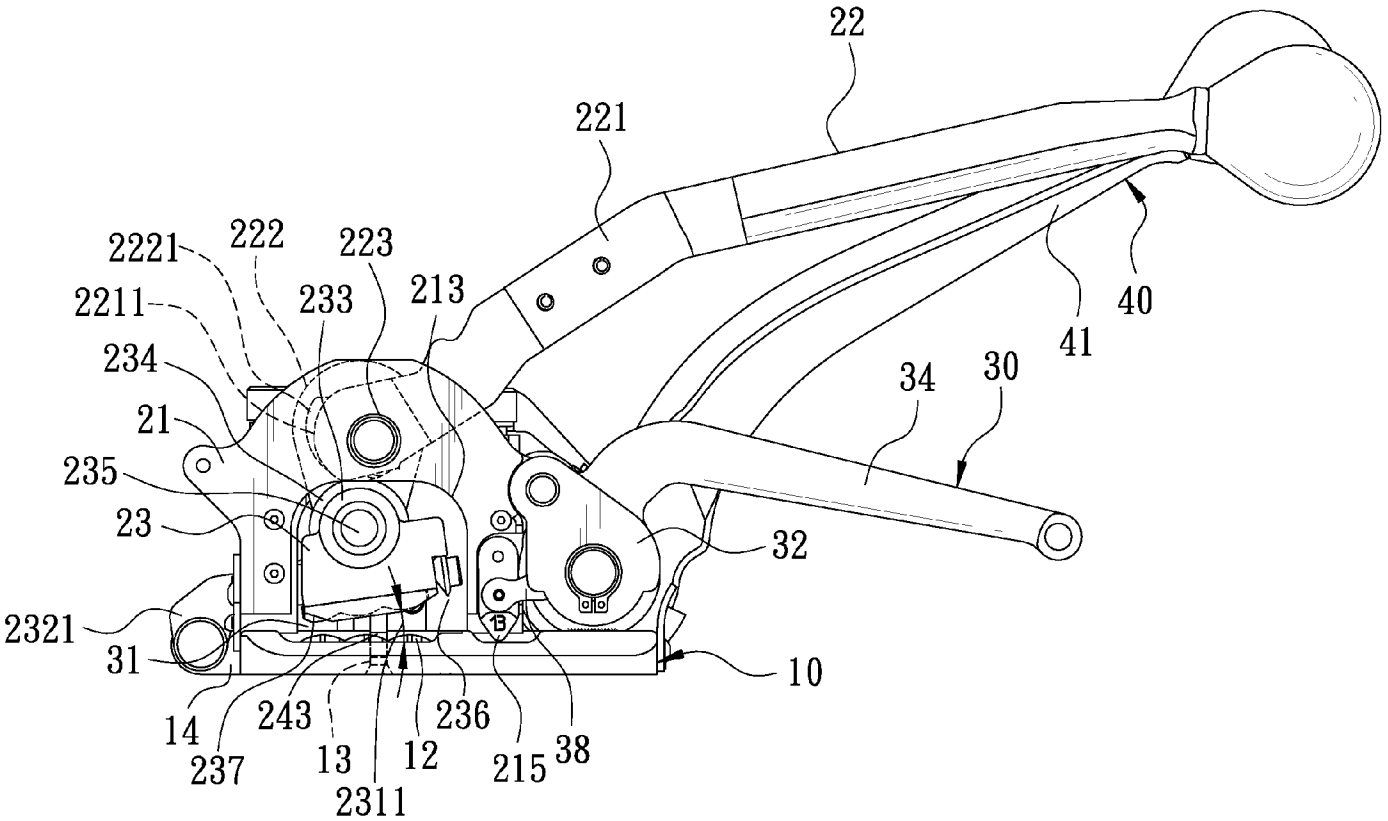
FIG. 5 is a partially side view of the present invention.
Figure 6:
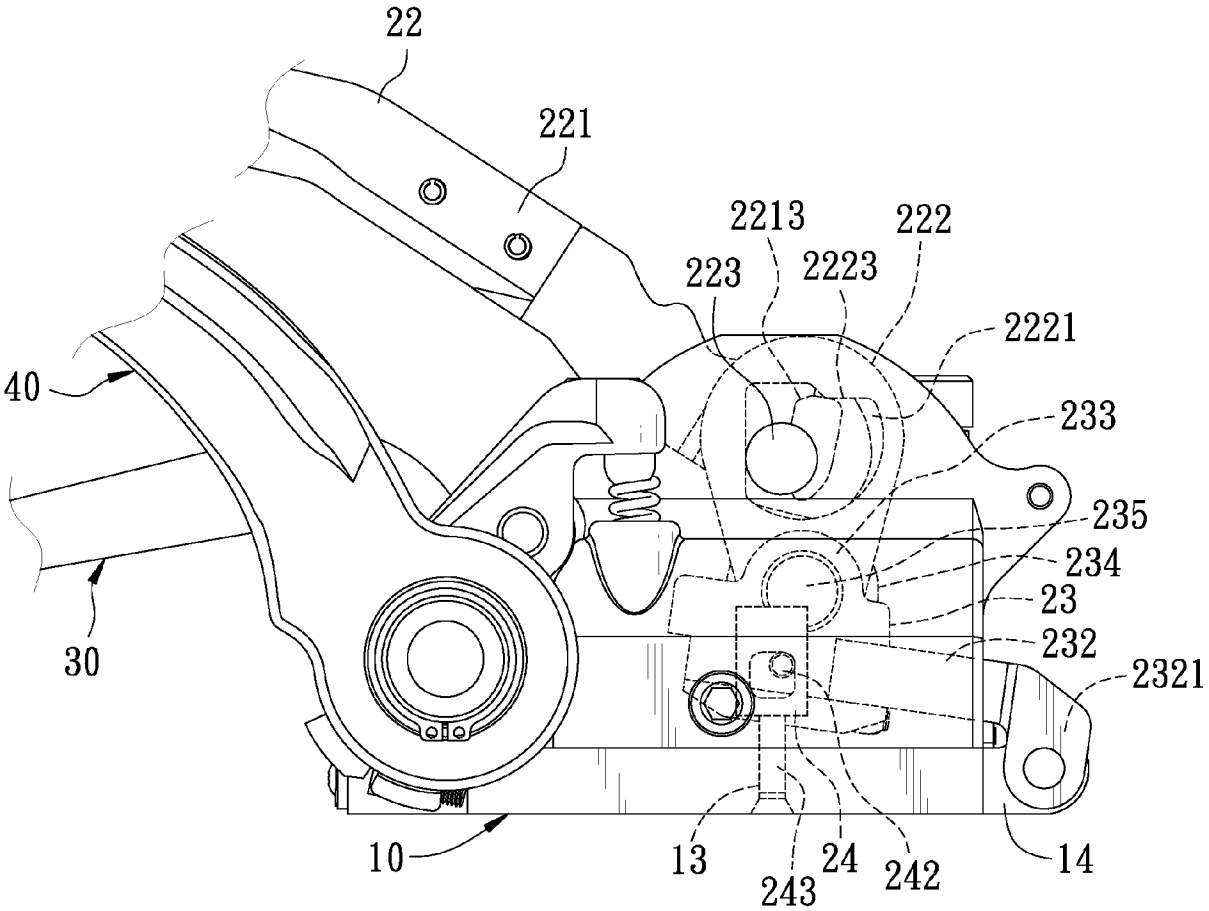
FIG. 6 is another partially side view of the present invention.

Embodiments of the present invention will now be described, by way of example only, with reference to the accompanying drawings.

As shown in FIGS. 2 to 6, a steel strapping tool 100 according to a preferred embodiment of the present invention comprises a base 10, a cutting unit 20, a release unit 30, and a reel unit 40.

The base 10 includes a recess 11 on top of one side of the base 10, a compressed block 12 disposed in the middle of the recess 11, a through hole 13 which is transversely disposed beside the compressed block 12, and a pivot block 14 extending from a front side of the base 10.

The cutting unit 20 is located on the base 10, and comprises a fixing seat 21, a top engaging rod set 22, a cutting assembly 23, and a hook member 24.

The fixing seat 21 includes a cover 211 and an elastic member 2111 at the front end of the fixing seat 21. The elastic member 2111 provides a closing force to the cover 211 and the fixing seat 21. When the cover 211 is not applied with an external force, the cover 211 is to cover the fixing seat 21, preventing bits from falling into the steel strapping tool 100. The fixing seat 21 comprises an axle connecting block 212 at a rear end of the fixing seat 21, an accommodating trough 213 which is lengthwise disposed in the middle of the fixing seat 21, a pair of connection holes 214 disposed at two sides of the fixing seat 21, a press block 215 disposed between the accommodating trough 213 and the axle connecting block 212, and a penetrating trough 216 at a front lower end of the fixing seat 21. The penetrating trough 216 is interconnected with the accommodating trough 213.

The top engaging rod unit 22 is pivotally connected to the pair of connection holes 214. The top engaging rod unit 22 includes a rod 221 and a linking plate 222. The rod 221 has a front end formed with a protruding engagement edge 2211 and an eccentric first pivot hole 2212. The top engaging rod unit 22 comprises a vertical engaging block 2213 which axially extends from one side of the first pivot hole 2212. The engaging block 2213 is gradually enlarged from one side to the other side thereof relative to the base 10. The linking plate 222 is located beside the first pivot hole 2212 and driven by the engaging block 2213. The linking plate 222 has an engaging hole 2221 at an upper portion thereof, a second pivot hole 2222 at a lower portion thereof, and a link protrusion 2223. The engaging hole 2221 is fitted on the engaging block 2213. The link protrusion 2223 extends from the upper section of the engaging hole 2221 of the linking plate 222 relative to the engaging block 2213. A shaft 223 is inserted through the pair of connection holes 214, the first pivot hole 2212 and the engaging hole 2221 so that the fixing seat 20, the linking plate 222 and the rod 221 are connected together.

The cutting assembly 23 is disposed in the accommodating trough 213 and under the top engaging rod unit 22. The cutting assembly 23 includes a cutting body 231 and a connecting member 232 which extends frontward from one side of the cutting body 231 and passes through the penetrating trough 216. The connecting member 232 has a free end provided with a pair of first pivot ears 2321 which extend downward from the free end. The pair of first pivot ears 2321 and the pivot block 14 are connected via a first pivot shaft 2322. The cutting body 231 includes a pair of second pivot ears 233 thereon, a roller 234 between the pair of second pivot ears 233, and a second pivot shaft 235 inserting through the pair of second pivot ears 233, the roller 234, and the second pivot hole 2222 of the linking plate 222, such that an included angle 2311 is defined between the cutting body 231 and the base 10. The protruding engagement edge 2211 leans against the roller 234. A cutter 236 is provided at a rear end of the cutting body 231. Two spaced compressing blocks 237 are provided under the cutting body 231. The two compressing blocks 237 correspond to the compressed block 12.

The hook member 24 is located beside the cutting assembly 23 and driven by the cutting assembly 23. The hook member 24 includes a link hole 241, a stop pin 242, and a hook block 243 disposed under the link hole 241. The link hole 241 is adapted for insertion of one end of the stop pin 242. Another end of the stop pin 242 is inserted in the cutting body 231. The hook block 243 extends underneath the compressing blocks 237 and is accommodated in the through hole 13.

The release unit 30 is coupled with the cutting unit 20. An accommodation space 31 is defined among the release unit 30, the cutting unit 20 and the base 10. The accommodation space 31 transversely defines an insertion end 311 and a stop end 312 opposite to the insertion end 311. The release unit 30 includes a release body 32. The release body 32 has a pair of connecting ears 33 at a front end thereof. The connecting ears 33 are pivotally connected with the axle connecting block 212 of the fixing seat 21, with the axle connecting block 212 as an axle center to swing back and forth. The release body 32 includes a handle 34 extending rearward from a rear end thereof, a pivot hole 35 at a central portion thereof, an opening 36 at one side thereof corresponding to the accommodation space 31, a press roller 37 disposed in the opening 36, and a pull guiding plate 38 disposed beside the press roller 37. The press roller 37 has a concave edge 371 on an inner wall thereof. The pull guiding plate 38 is coupled with the press block 215. When the handle 34 of the release body 32 is lifted up, the pull guiding plate 38 will be linked to pull the press block 215 to move.

The reel unit 40 is pivotally connected to the release body 32. The reel unit 40 includes a reel rod 41 and a pivot rod 42. The reel rod 41 has a through hole 411 at a front end thereof and a one-way bearing 412 received in the through hole 411. The pivot rod 42 is inserted through the one-way bearing 412 and pivotally connected to the pivot hole 35 of the release body 32. The pivot rod 42 is provided with an axial pivot axle 421 which corresponds to the press roller 37. The pivot axle 421 is provided with a protruding block 422 corresponding to the concave edge 371 of the press roller 37.

Figure 7:
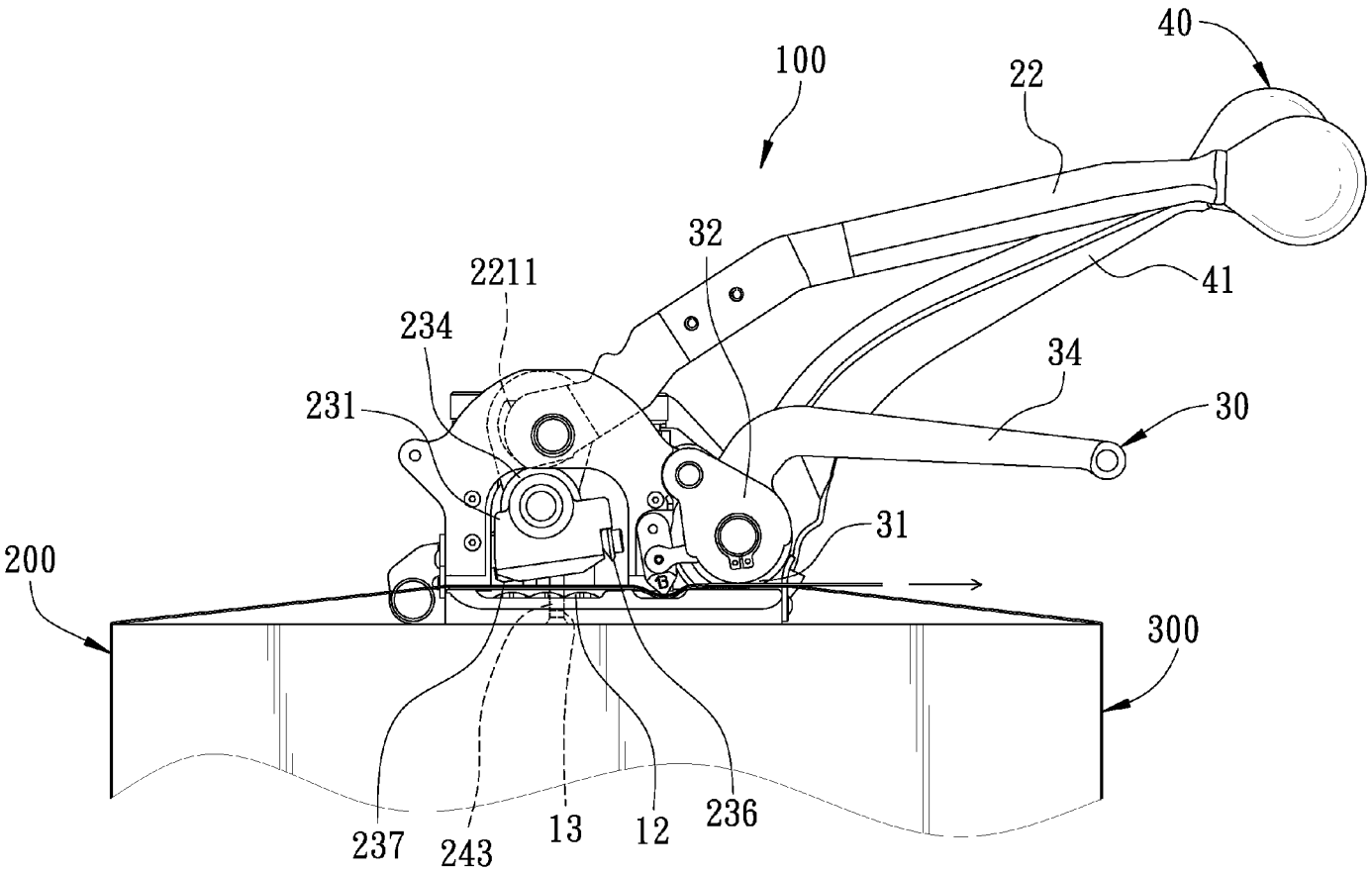
FIG. 7 is a schematic view showing the present invention when in use.
Figure 8:
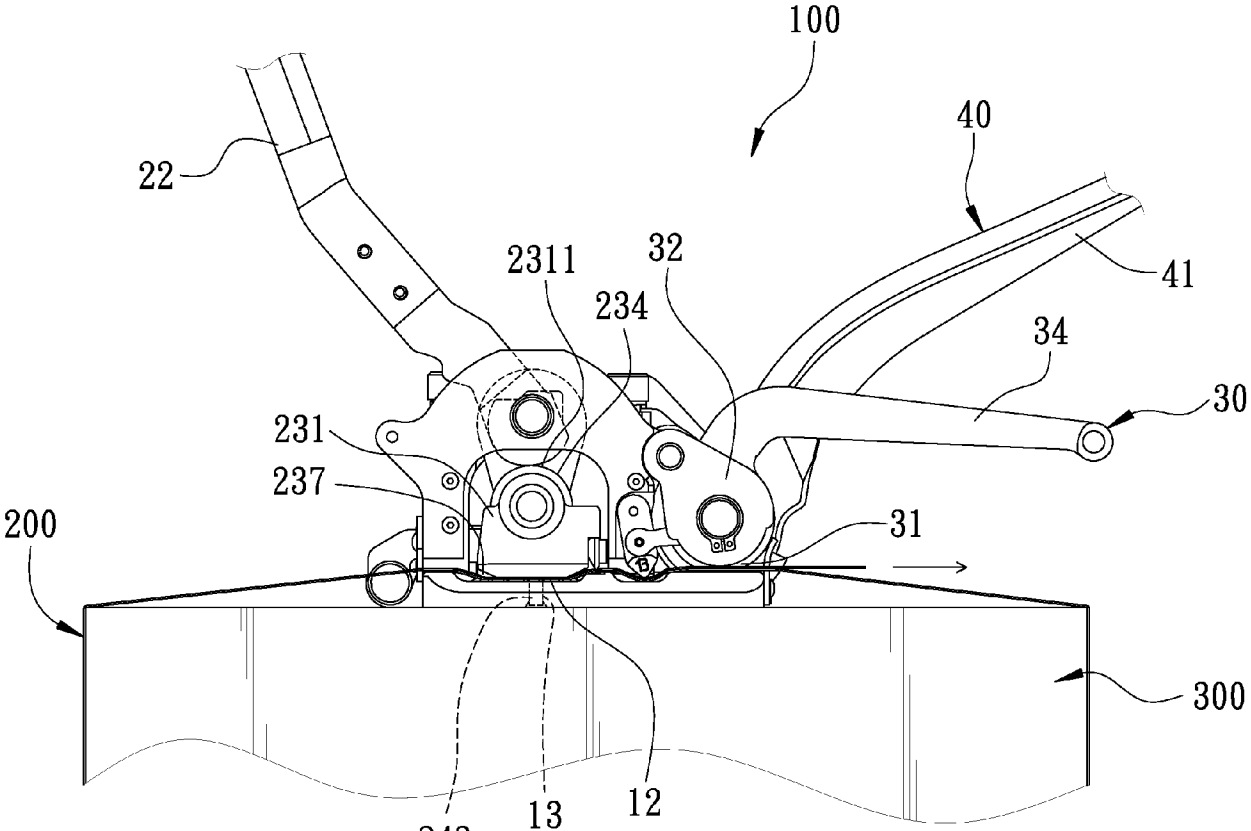
FIG. 8 is a schematic view showing the buckling procedure of the steel strap of the present invention.

FIG. 7 and FIG. 8 are schematic views showing the steel strapping tool of the present invention when in use. A steel strap 200 surrounds an object 300, and two ends of the steel strap 200 are inserted in the accommodation space 31 respectively and overlapped each other. The press block 215 and the press roller 37 assist in pressing the steel strap 200, preventing the steel strap 200 from disengagement. The reel rod 41 of the reel unit 40 is swung forward and backward to drive the press roller 37 to move in a one-way direction and the steel strap 200 to move rearward so as to achieve a tightening effect. The top engaging rod unit 22 is pulled forward, so that the protruding engagement edge 2211 of the top engaging rod unit 22 presses the roller 234 to bring the cutting body 231 to move downward. The first pivot hole 2212 of the top engaging rod unit 22 is eccentric. When the top engaging rod is pulled forward, the engagement edge 2211 will push the cutting body 231 to move downward. The front ends of the compressing blocks 237 of the cutting body 231 hold against the steel strap 200, and then the compressing blocks 237 are to press the steel strap 200 entirely, such that the steel strap 200 is pressed firmly and the user can operate the steel strapping tool with ease. Furthermore, when the top engaging rod unit 22 is further pulled forward, the compressing blocks 237 and the compressed block 12 make the overlapped steel strap 200 engaged with each other tightly. The cutter 236 is to cut the surplus steel strap 200. The user can press the release unit 30 and pull the top engaging rod unit 22 forward at the same time. Thus, the user can operate the steel strapping tool 100 for engagement of the steel strap 200 and cut the surplus steel strap 200 with ease.

Figure 9:
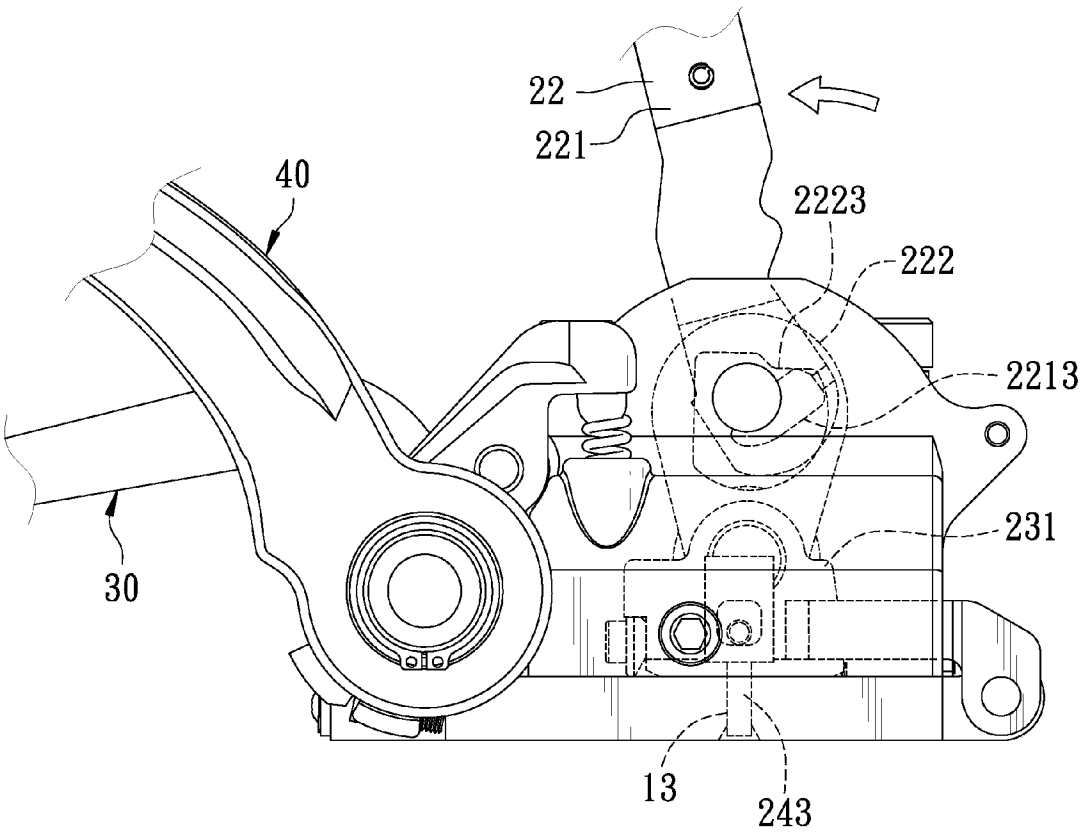
FIG. 9 is a schematic view showing the engaging block to link the linking plate of the present invention.
Figure 10:
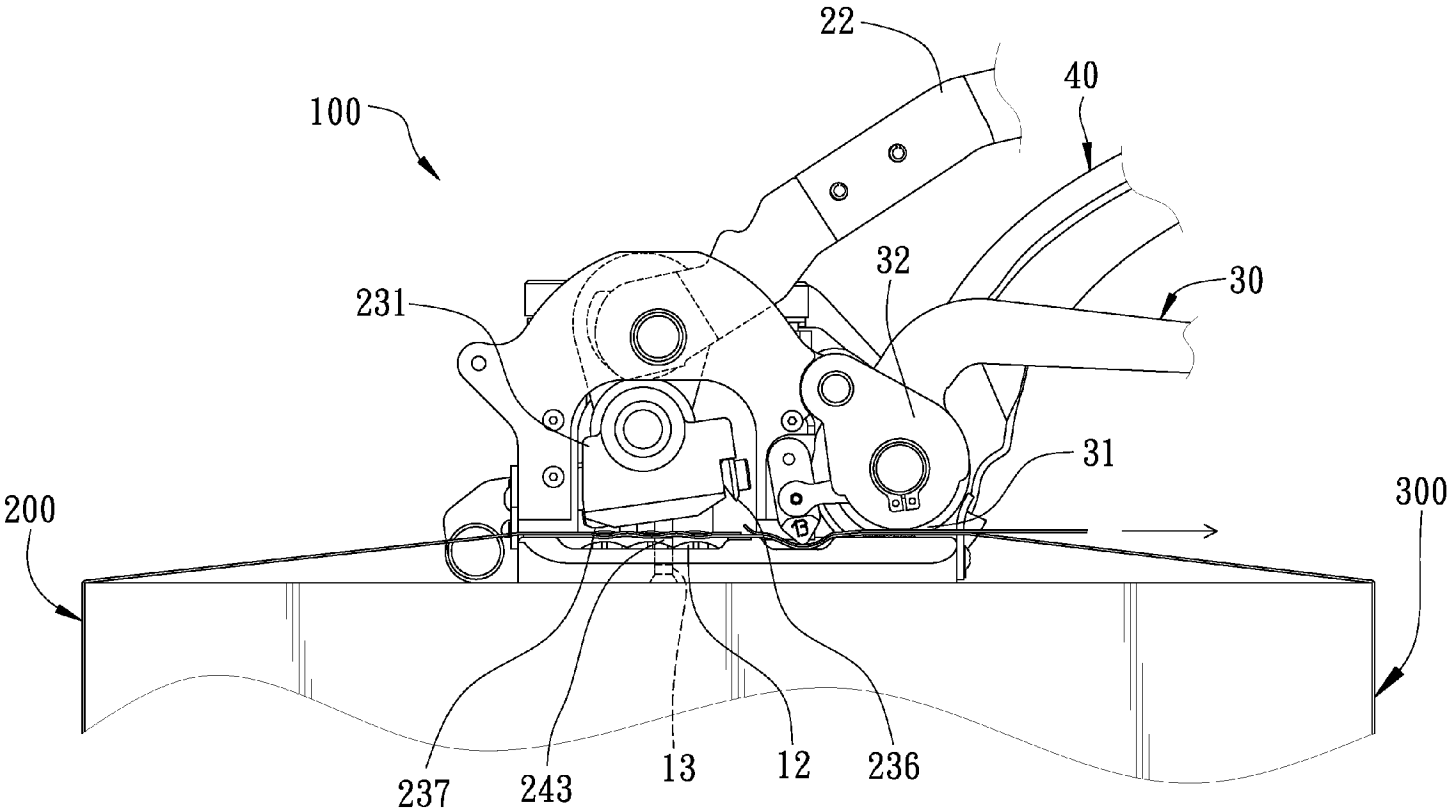
FIG. 10 is a schematic view showing the hook block to hook the steel strap out.

Referring to FIG. 9 and FIG. 10, when the top engaging rod unit 22 is pulled rearward, the engaging block 2231 of the top engaging rod unit 22 will bring the linking plate 222 to move upward. Because the engaging block 2213 is gradually enlarged from one side to the other side relative to the base 10, cooperating with the lever principle, the force is transmitted to the link protrusion 2223 of the linking plate 222 to lift the cutting body 231 when the top engaging rod unit 22 is pulled forward. The cutting body 231 will drive the hook block 243 of the hook member 24 upward to hook the steel strap 200 out, preventing the steel strap 200 from getting stuck on the compressed block 12. The user can pull the top engaging rod unit 22 rearward and press the cover 22 at the same time to hook the steel strap 200 out. Finally, the handle 34 of the release unit 30 is lifted up, and the release body 32 is linked to move upward, such that the press block 215 and the press roller 37 are disengaged from the steel strap 200 and the steel strapping tool 100 is laterally moved out to finish baling.

When the steel strapping tool 100 is not in use, the cover 211 is to cover the fixing seat 21 for the user to hold the steel strapping tool 100 by hand, preventing the user's finger from inserting into the steel strapping tool 100 as well as avoiding the bits from falling into the steel strapping tool 100 to influence the packing efficiency. When the cover 211 is opened or closed relative to the pull operation of the top engaging rod unit 225, the cover 211 won't influence the packing procedure. When the operator uses the hook member 24 to assist in hooking the steel strap 200 out, he/she can press the cover 211. This provides the operator an energy-saving and exact way to hook the steel strap 200 out, not influencing the steel strap 200 which has been pressed and engaged.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A steel strapping tool with a pressing strap structure, the steel strapping tool comprising a base, a compressed block at one side of the base and a cutting unit on top of the base, the cutting unit comprising a fixing seat which has an accommodating trough therein, a top engaging rod unit disposed in the accommodating trough, a cutting assembly having one end coupled to the top engaging rod unit and received in the accommodating trough, and characterized by:

the base including a pivot block extending from a front side thereof and a through hole which is transversely disposed beside the compressed block, the cutting assembly including a cutting body and a connecting member which extends frontward from one side of the cutting body and passes through the fixing seat, the connecting member being pivotally connected with the pivot block of the base, between the cutting body and the base defining an included angle, the cutting unit comprising a hook member located beside the cutting assembly, the hook member including a link hole, a stop pin and a hook block disposed under the link hole, the link hole being adapted for insertion of one end of the stop pin, another end of the stop pin being inserted in the cutting assembly to link the hook member and the cutting assembly, the hook block extending underneath the compressing blocks and being accommodated in the through hole of the base;

wherein, after the tool strapping tool fastens and cuts the steel strap, the hook block of the cutting body moves upward to assist in hooking the steel strap out, preventing the steel strap from getting stuck on the compressed block to enhance the steel strapping tool;

wherein the top engaging rod unit is pivotally connected to the fixing seat, the top engaging rod unit including a rod and a linking plate, the rod having a front end formed with a protruding engagement edge and an eccentric first pivot hole, the top engaging rod unit comprising a vertical engaging block which axially extending from one side of the first pivot hole, the linking plate being located beside the first pivot hole and driven by the engaging block, the linking plate having an engaging hole at an upper portion thereof and a second pivot hole at a lower portion thereof, the engaging hole being fitted on the engaging block, a shaft inserting through the first pivot hole and the engaging hole to be pivotally connected to the fixing seat, the cutting body including a pair of second pivot ears thereon, a roller between the pair of second pivot ears, and a second pivot shaft inserting through the pair of second pivot ears, the roller, and the second pivot hole of the linking plate, the protruding engagement edge leaning against the roller; and wherein the engaging block is gradually enlarged from one side to another side thereof relative to the base, a link protrusion extending from an upper section of the engaging hole of the linking plate relative to the engaging block.

2. The steel strapping tool with a pressing strap structure as claimed in claim 1, wherein the connecting member has a free end provided with a pair of first pivot ears which extend downward from the free end, the pair of first pivot ears and the pivot block being connected via a first pivot shaft.

3. The steel strapping tool with a pressing strap structure as claimed in claim 1, wherein the fixing seat has a penetrating trough at a front lower end thereof, the connecting member passing through the penetrating trough to be pivotally connected to the pivot block.

4. The steel strapping tool with a pressing strap structure as claimed in claim 1, wherein the fixing seat includes a cover and an elastic member at a front end of the fixing seat, when the cover is not applied with an external force, the cover is to cover the fixing seat.

* * * * *